US010250970B2

(12) United States Patent
Tanabe

(10) Patent No.: US 10,250,970 B2
(45) Date of Patent: Apr. 2, 2019

(54) ACOUSTIC APPARATUS

(71) Applicant: ALPINE ELECTRONICS, INC., Shinagawa-ku, Tokyo (JP)

(72) Inventor: Kei Tanabe, Fukushima (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 15/836,025

(22) Filed: Dec. 8, 2017

(65) Prior Publication Data

US 2018/0220226 A1 Aug. 2, 2018

(30) Foreign Application Priority Data

Jan. 31, 2017 (JP) ..... 2017-015338

(51) Int. Cl.

| | |
|---|---|
| ***H04R 7/02*** | (2006.01) |
| ***H04R 1/28*** | (2006.01) |
| ***H04R 31/00*** | (2006.01) |
| ***H04R 1/02*** | (2006.01) |
| ***H04R 9/02*** | (2006.01) |
| ***H04R 7/12*** | (2006.01) |
| *H04R 9/06* | (2006.01) |

(52) U.S. Cl.

CPC ..... *H04R 1/2834* (2013.01); *H04R 1/025* (2013.01); *H04R 7/122* (2013.01); *H04R 9/025* (2013.01); *H04R 31/003* (2013.01); *H04R 7/125* (2013.01); *H04R 9/06* (2013.01); *H04R 2307/029* (2013.01)

(58) Field of Classification Search

CPC . H04R 7/02; H04R 7/06; H04R 7/122; H04R 7/125; H04R 9/06; H04R 31/003; H04R 2307/023; H04R 2307/025; H04R 2307/029

USPC ..... 381/184, 186, 398, 423, 424, 426, 428, 381/432; 181/166, 167, 169, 170; 29/594, 609.1

See application file for complete search history.

(56) References Cited

U.S. PATENT DOCUMENTS

| | | | | |
|---|---|---|---|---|
| 9,438,997 | B2 * | 9/2016 | Jin | H04R 7/06 |
| 2007/0286448 | A1 * | 12/2007 | Sato | H04R 7/125 381/424 |

(Continued)

FOREIGN PATENT DOCUMENTS

| | | |
|---|---|---|
| JP | 2007-318405 | 12/2007 |

*Primary Examiner* — Huyen D Le
(74) *Attorney, Agent, or Firm* — Brinks, Gilson & Lione

(57) ABSTRACT

An acoustic apparatus may include a frame having an axially-opening annular open portion; a diaphragm supported by being attached to the annular open portion via a flexible edge member so as to be capable of vibrating in the axial direction; and a driving unit connected, at a connection portion at a center portion of the diaphragm, to the diaphragm to apply an axial-direction driving force to the diaphragm. The diaphragm includes first and second diaphragms that are mutually adjacent in the axial direction and joined together. When viewed in the axial direction, the second diaphragm has an outer diameter smaller than that of the first diaphragm. Each diaphragm includes a sheet member having an orientation dispersion structure including a shape-anisotropic filler dispersed in a resin with the long axis thereof oriented in a predetermined direction. The orientation directions of the sheet members of the first and second diaphragms mutually intersect.

7 Claims, 6 Drawing Sheets

(56) References Cited

U.S. PATENT DOCUMENTS

2016/0014520 A1* 1/2016 Miura ..... H04R 7/125
181/164
2018/0220227 A1* 8/2018 Tanabe ..... H04R 7/02

* cited by examiner

ACOUSTIC APPARATUS

RELATED APPLICATIONS

The present application claims priority to Japanese Patent Appln. No. 2017-015338, filed Jan. 31, 2017, the entire disclosure of which is hereby incorporated by reference.

BACKGROUND

1. Field of the Disclosure

The present disclosure relates to an acoustic apparatus (speaker) having improved acoustic characteristics, in particular, high-range acoustic characteristics.

2. Description of the Related Art

Acoustic apparatuses (speakers) should have the ability to reproduce original sounds as accurately as possible. To satisfy this objective, speaker components, such as diaphragms, have been improved in various ways.

For example, Japanese Unexamined Patent Application Publication No. 2007-318405 (hereinafter referred to as Patent Literature 1) discloses a multi-layered electro-acoustic transducer diaphragm including an intermediate diaphragm layer between a first surface diaphragm layer and a second surface diaphragm layer, in which the first surface diaphragm layer and the second surface diaphragm layer are formed of woven fabric and are integral with each other with the fiber axis directions thereof shifted from each other in a circumferential direction by a prescribed angle.

In the diaphragm, in which the first surface diaphragm layer, the intermediate diaphragm layer, and the second surface diaphragm layer are integral with each other with the fiber axis directions of the first surface diaphragm layer and the second surface diaphragm layer shifted from each other in the circumferential direction by the prescribed angle, for example, approximately 45 degrees in a case where biaxial fabric is employed as the first and second surface diaphragm layers, deformation directions of the first and second surface diaphragm layers are shifted from each other by the prescribed angle. Such a structure is considered to reduce distortion, deformation, and the like of the electro-acoustic transducer diaphragm and, as a result, achieve a high-quality multi-layered diaphragm with less distortion.

By using a fiber material, such as that disclosed in Patent Literature 1, as a reinforcement material, mechanical characteristics, including strength and the like, of a diaphragm can be improved. When a strength of the diaphragm is increased, the resonant frequency thereof increases, and thus, improvement in acoustic characteristics is expected. However, a multi-layered diaphragm, such as that described in Patent Literature 1, tends to have a large mass; thus, it is difficult to obtain improved high-range acoustic characteristics.

SUMMARY

To address such circumstances in the related art, the present disclosure provides an acoustic apparatus that includes, as a reinforcement material, a shape-anisotropic filler, such as fiber, to improve mechanical characteristics of a diaphragm and to prevent degradation in acoustic characteristics from easily occurring in high ranges.

In one aspect of the present disclosure, an acoustic apparatus (speaker) includes a frame having an annular open portion that opens in an axial direction; a diaphragm supported by being attached to the annular open portion via a flexible edge member so as to be capable of vibrating in the axial direction; and a driving unit that is connected, at a connection portion positioned at a center portion of the diaphragm, to the diaphragm and applies a driving force in the axial direction to the diaphragm. The diaphragm includes a first diaphragm and a second diaphragm that has an outer diameter that is smaller, when viewed in the axial direction, than an outer diameter of the first diaphragm. The first diaphragm and the second diaphragm are adjacent to each other in the axial direction and joined together. Each of the first diaphragm and the second diaphragm includes a sheet member having an orientation dispersion structure that includes a shape-anisotropic filler dispersed in a resin with the long axis thereof oriented in a predetermined direction. The orientation direction of the sheet member of the first diaphragm intersects the orientation direction of the sheet member of the second diaphragm.

Compared with a case in which two diaphragms having the same size are simply laminated using, for example, an adhesive, the weight of the whole diaphragm can be greatly reduced by disposing diaphragms having different outer diameters when viewed in the axial direction so as to be adjacent to each other in the axial direction and joining the diaphragms together, instead of laminating a plurality of diaphragms having the same shape as in the case of the diaphragms described in Patent Literature 1. Moreover, the mechanical characteristics of the diaphragms can be improved by using, as a material constituting each of the diaphragms adjacent to each other in the axial direction, the sheet member having the orientation dispersion structure that includes the shape-anisotropic filler dispersed in the resin with the long axis thereof oriented in the predetermined direction. Furthermore, compared with a case in which the orientation directions of the sheet members are aligned with each other, variations in the mechanical characteristics of the whole diaphragm in the circumferential direction with the axis thereof as the center can be reduced by disposing the sheet members such that the orientation directions intersect each other instead of being aligned with each other. As a result, a vibration loss at high frequencies can be reduced and a resonant frequency of the diaphragms can be increased, which can improve the acoustic characteristics of the acoustic apparatus, in particular, the high-range acoustic characteristics.

Specific shapes of the first diaphragm and the second diaphragm of the acoustic apparatus are not limited. In an example, the first diaphragm includes the flexible edge member to thereby be attached to the annular open portion and includes the connection portion at the center portion of the first diaphragm; the second diaphragm viewed in the axial direction has an outer shape that is included in an outer shape of the first diaphragm viewed in the axial direction; and the second diaphragm has an outer circumferential edge that is joined to a portion of the first diaphragm, the portion being positioned closer than the connection portion of the first diaphragm to an outer circumference side. In the structure, the driving unit may include a magnetic circuit having a magnetic gap, a cylindrical bobbin inserted into the magnetic gap, and a voice coil wound around the bobbin; and the second diaphragm may form a dust cap that covers the bobbin. With such a structure, which can reduce the number of vibrating components in the acoustic apparatus, further improvement in the acoustic characteristics of the acoustic apparatus and improvement in ease of assembly during manufacture of the acoustic apparatus are expected.

In another example, the first diaphragm includes the flexible edge member to thereby be attached to the annular open portion; the second diaphragm viewed in the axial direction has an outer shape that is included in an outer shape of the first diaphragm viewed in the axial direction; and the second diaphragm has an outer circumferential edge joined to the first diaphragm and includes the connection portion at the center portion of the second diaphragm.

In the above acoustic apparatus, an intersection angle between an orientation direction of the sheet member of the first diaphragm and an orientation direction of the sheet member of the second diaphragm may be 45 degrees or more from a viewpoint of reducing variations in the mechanical characteristics in the circumferential direction with the axis thereof as the center in the whole diaphragm. From such a viewpoint, the intersection angle may be 70 degrees or more. In particular, the orientation directions of the diaphragms may be orthogonal to each other. Note that, in the present specification, an intersection angle is defined as an angle from 0 to 90 degrees, and orthogonal denotes an intersection angle of 85 degrees or more.

In the above acoustic apparatus, mechanical characteristics in the orientation direction may differ from mechanical characteristics in a direction orthogonal to the orientation direction in each sheet member having the orientation dispersion structure. The sheet member of the first diaphragm and the sheet member of the second diaphragm that are arranged such that the orientation directions thereof intersect each other reduce, in the whole diaphragm, a difference between the mechanical characteristics in the orientation direction of the sheet member of the first diaphragm and the mechanical characteristics in the direction orthogonal to the orientation direction of the sheet member of the first diaphragm and a difference between the mechanical characteristics in the orientation direction of the sheet member of the second diaphragm and the mechanical characteristics in the direction orthogonal to the orientation direction of the sheet member of the second diaphragm. Therefore, even when the sheet members having anisotropic mechanical characteristics are used as members constituting the diaphragms, degradation in the acoustic characteristics due to the anisotropic mechanical characteristics of the sheet members is prevented from easily occurring.

In the above acoustic apparatus, each sheet member may contain a thermoplastic resin as a base material (a main constituent material, specifically, a constituent material of a matrix material that includes a filler dispersed therein); and each of the first diaphragm and the second diaphragm is preferably a vacuum-formed article or a pressure-formed article. Such an acoustic apparatus achieves a reduction in mold costs and a reduction in manufacturing costs.

As discussed in conjunction with implementations of the present disclosure, an acoustic apparatus can improve mechanical characteristics of a diaphragm by using, as a reinforcement material, a shape-anisotropic filler and suppress degradation in high-range acoustic characteristics.

DETAILED DESCRIPTION OF THE DRAWINGS

Figure 1A:
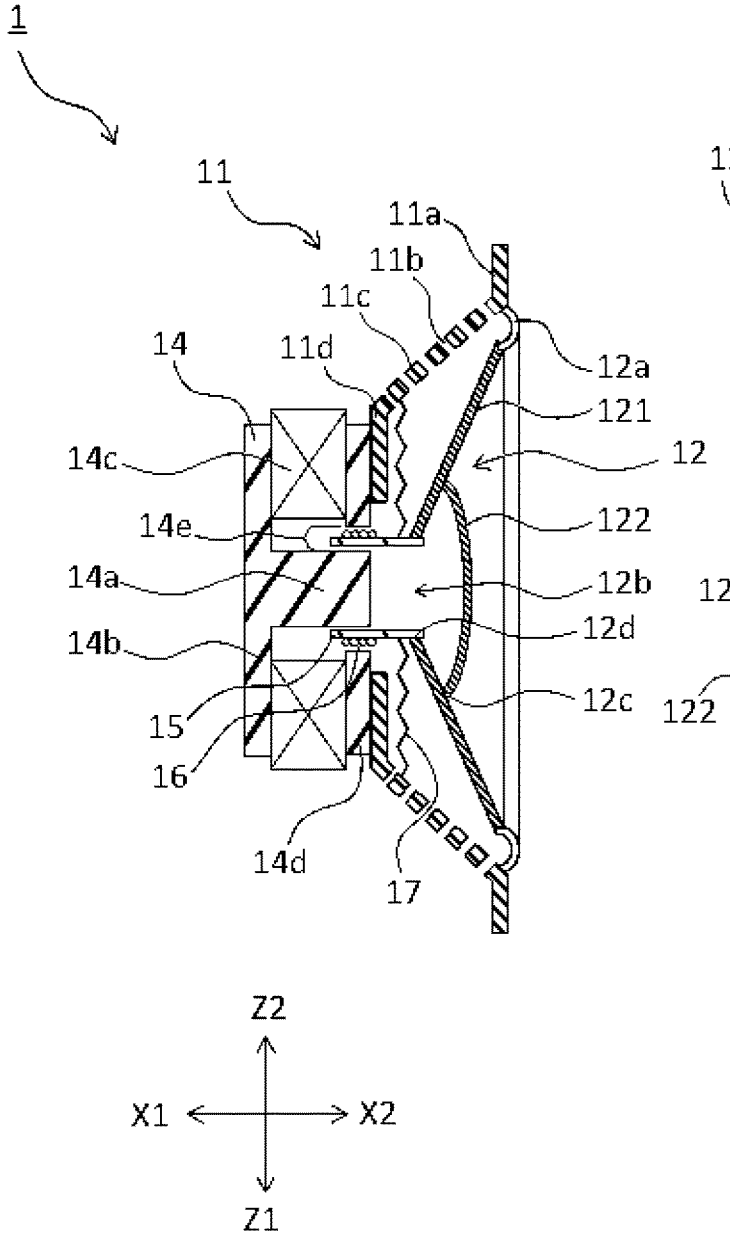
FIG. 1A is a conceptual sectional view illustrating one form of a structure of a speaker according to a first embodiment of the present disclosure.
Figure 1B:
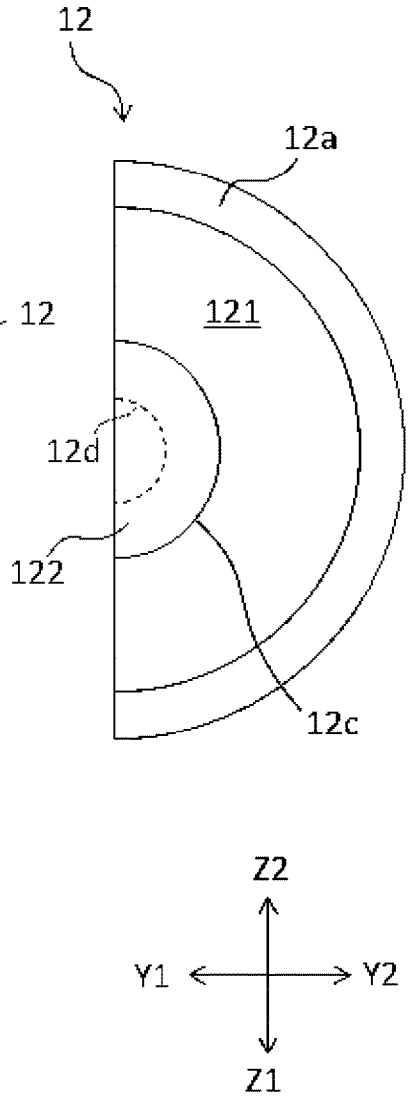
FIG. 1B is a partial plan view in the X1-X2 direction, illustrating a structure of a diaphragm included in the speaker.
Figure 2A:
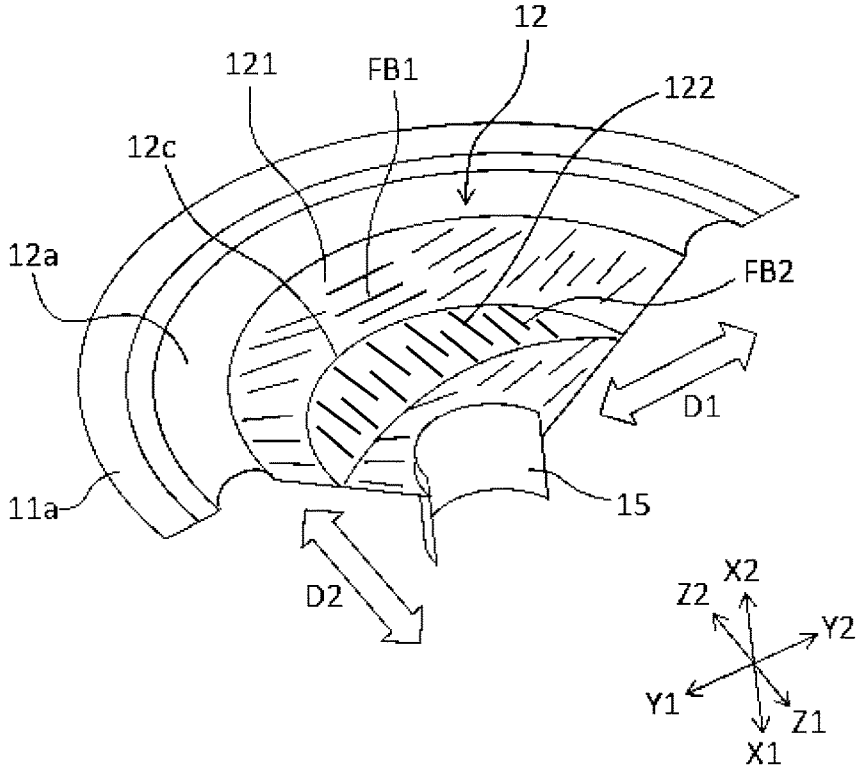
FIG. 2A is a sectional perspective view illustrating one form of the structure of the diaphragm of the speaker according to the first embodiment.
Figure 2B:
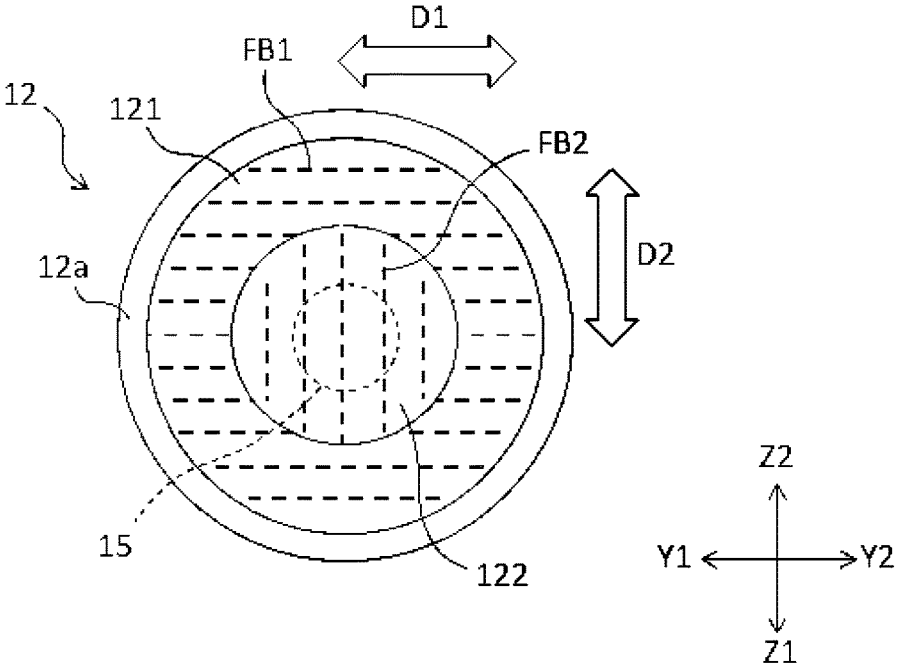
FIG. 2B is a plan view in the X1-X2 direction, illustrating one form of the structure of the diaphragm of the speaker according to the first embodiment.

Embodiments and implementations of the present disclosure will be described below with reference to the drawings. FIG. 1A is a conceptual sectional view illustrating one form of a structure of a speaker according to the first embodiment of the present disclosure. FIG. 1B is a partial plan view in the X1-X2 direction, illustrating a structure of a diaphragm included in the speaker. In the plan view, a shape appearing on the Y1 side in the Y1-Y2 direction is the same as the shape appearing on the Y2 side in the Y1-Y2 direction; thus, the plan view shows only the Y2 side. The same is true for the partial plan views in FIGS. 3A and 5A. FIG. 2A is a sectional perspective view and FIG. 2B is a plan view in the X1-X2 direction, both illustrating the structure of the diaphragm of the speaker according to the first embodiment. The sectional perspective view shows a section in which a sectional area of the diaphragm of the speaker is maximum.

As illustrated in FIG. 1A, a speaker 1 according to forms of the present disclosure may include a frame 11 having a substantially truncated cone shape and various members attached to the frame 11. The frame 11 includes, at an outer circumferential edge thereof, an annular open portion 11*a* having a circular-ring shape and a spoke-like support 11*c* extending from the annular open portion 11*a*. In the drawing, the support 11*c* is indicated by a discontinuous line having cut-out holes 11*b* for convenience of understanding.

A diaphragm 12 that generates a sound pressure in the speaker 1 includes a flexible edge member 12*a* at an outer circumferential edge of the diaphragm 12. The diaphragm 12 is supported by being attached to the annular open portion 11*a* via the flexible edge member 12*a* so as to be capable of vibrating in an axial direction (X1-X2 direction in FIG. 1A). The diaphragm 12 includes a first diaphragm 121 and a second diaphragm 122 that are adjacent to each other in the axial direction (X1-X2 direction) and joined together.

The first diaphragm 121 has a substantially truncated cone shape and has a circular outer shape when viewed in the axial direction (X1-X2 direction). The first diaphragm 121 includes the flexible edge member 12*a* at an outer circumferential edge thereof and is attached to the annular open portion 11*a* of the frame 11 via the flexible edge member 12*a*. In the speaker 1 in FIG. 1A, specifically, the flexible edge member 12*a* is bonded to the annular open portion 11*a* of the frame 11 by using an adhesive. Supported by the frame 11, as described above, the first diaphragm 121 can vibrate in the X1-X2 direction. The first diaphragm 121 includes an opening (diaphragm opening) 12*b* at a portion that is at the center when viewed in the axial direction (X1-X2 direction). The diaphragm opening 12*b* has an inner circumferential surface that serves, as described later, as a connection portion 12*d* with respect to a bobbin 15, which is a part of a driving unit.

The second diaphragm 122 has a substantially hollow hemispherical-cap shape. An outer shape of the second diaphragm 122 viewed in the axial direction (X1-X2 direction) is circular, as is the case with the first diaphragm 121. However, the second diaphragm 122 has an outer diameter smaller than that of the first diaphragm 121. Thus, due to a difference in diameter, the outer shape of the second diaphragm 122 viewed in the axial direction is included in the outer shape (circular shape) of the first diaphragm 121 viewed in the axial direction. The second diaphragm 122 is attached to the first diaphragm 121, on the X2 side in the X1-X2 direction, so as to cover an inner circumference side, including the diaphragm opening 12*b*, of the first diaphragm 121. In other words, the outer circumferential edge of the second diaphragm 122 is joined, as a joined portion 12*c* with respect to the first diaphragm 121, to a portion of the first diaphragm 121, the portion being positioned closer than the connection portion 12*d* of the first diaphragm 121 to an outer circumference side.

The support 11*c* of the frame 11 has a truncated cone shape and has a top portion (magnetic circuit mount portion 11*d*) on which a magnetic circuit 14 is mounted. The magnetic circuit 14 includes a columnar center pole 14*a*. The center pole 14*a* has a central axis directed in a vibration direction (axial direction (X1-X2 direction)) of the diaphragms. Around the rear (the X1 side in the X1-X2 direction) of the center pole 14*a*, a bottom plate 14*b* is disposed so as to be integral with the center pole 14*a*. On the front side (the X2 side in the X1-X2 direction) of the bottom plate 14*b*, an annular magnet 14*c* is mounted. On the front side (the X2 side in the X1-X2 direction) of the magnet 14*c*, an annular top plate 14*d* is mounted. The provision of the magnet 14*c* forms an annular magnetic gap 14*e* between the center pole 14*a* and the top plate 14*d*. The bottom plate 14*b* and the top plate 14*d* form a yoke.

On the rear side (the X1 side in the X1-X2 direction) of the diaphragm 12, the bobbin 15 having a cylindrical shape is secured. As illustrated in FIG. 1A, the bobbin 15 is inserted into the magnetic gap 14*e* of the magnetic circuit 14 positioned on the rear side (the X1 side in the X1-X2 direction) of the diaphragm 12. The bobbin 15 includes a portion inserted into the magnetic gap 14*e*, the portion having a side surface around which a voice coil 16 is wound. The bobbin 15 reciprocates in the axial direction (X1-X2 direction) in accordance with an electric current flowing through the voice coil 16 positioned inside the magnetic gap 14*e*, which causes the diaphragm 12 to vibrate and generate a sound pressure.

In the axial direction (X1-X2 direction), a damper 17 is disposed between the diaphragm 12 and the magnetic circuit 14. The damper 17 is supported, at an outer circumference side thereof, by the support 11*c* of the frame 11 and supports, at an inner circumference side thereof, the bobbin 15. Along with the reciprocation of the bobbin 15, the damper 17, as well as the diaphragm 12, also reciprocates in the axial direction (X1-X2 direction). The damper 17 is formed of an elastic member. In a state in which no electric current flows through the voice coil 16, the damper 17 has a function of returning the bobbin 15 to a neutral position by using an elastic recovery force.

The speaker 1 having such a structure can generate, as described above, a sound pressure in the axial direction X1 (X1-X2 direction) by causing an electric current to flow through the voice coil 16 to thereby cause the diaphragm 12 to vibrate. The proportionality coefficient between the magnitude of the electric current flowing through the voice coil 16 and the magnitude of a sound pressure to be generated is ideally the same at any frequency. However, in reality, for example, the resonant frequency of the speaker 1 influences the frequency dependence of the sound pressure to have a peak (a range in which the sound pressure is high) and a dip (a range in which the sound pressure is low) in a specific range. Improving mechanical characteristics of the diaphragm 12 is one remedy for such acoustic characteristics. Improving the mechanical characteristics of the diaphragm 12 can reduce the number of produced resonance modes and increase the resonant frequency to thereby cause the resonance modes to shift outside the audible range.

The first diaphragm 121 and the second diaphragm 122 of the speaker 1 may be respectively formed of a sheet member having an orientation dispersion structure that includes a shape-anisotropic filler FB1 dispersed in a resin with the long axis thereof oriented in one predetermined direction and a sheet member having an orientation dispersion structure that includes a shape-anisotropic filler FB2 dispersed in a resin with the long axis thereof oriented in one predetermined direction. Being formed of the sheet members each having the orientation dispersion structure, as described above, the first diaphragm 121 and the second diaphragm 122 improve the mechanical characteristics of the diaphragms, compared with a case in which the fillers FB1 and FB2 are not contained. As a result, the mechanical characteristics of the diaphragm 12, in which the first diaphragm 121 and the second diaphragm 122 are joined together, can be improved.

Examples of the shape-anisotropic fillers FB1 and FB2 include carbon-based materials, such as carbon fibers and carbon nanotubes, and oxide-based materials, such as glass fibers. The length of each of the fillers FB1 and FB2 is desirably determined. Non-limiting examples of the length are a length between 0.01 and 10 mm and, for example, from a viewpoint of ease of handling, preferably a length between 0.1 mm and several millimeters. The aspect ratio, which is a ratio of the length of a major axis with respect to the length of a minor axis, of each filler may be any ratio. In some implementations, the aspect ratio of each filler may be 5 or higher. The type of resin contained in each sheet member is not limited. Non-limiting examples of the resin are polyolefin, such as polyethylene and polypropylene; polyester, such as polyethylene terephthalate; polyamide, such as nylon 6,6; polyvinyl chloride; and polyimide. In a case of performing extrusion forming or vacuum forming, a thermoplastic resin is preferable from a viewpoint of ease of handling.

Having the orientation dispersion structure that includes the oriented and dispersed filler FB1 and the orientation dispersion structure that includes the oriented and dispersed filler FB2, respectively, the sheet members both have anisotropic mechanical characteristics. Specifically, the mechanical characteristics in the orientation direction and the mechanical characteristics in a direction orthogonal to the orientation direction are different from each other, and flexural rigidity in the orientation direction is greater than flexural rigidity in the direction orthogonal to the orientation direction. Due to the oriented and dispersed fillers FB1 and FB2, the mechanical characteristics in the orientation direction improves, and as a result, the mechanical characteristics in the whole diaphragm 12 can improve. The anisotropic mechanical characteristics are not limited. A sheet member that contains an oriented and dispersed filler usually has high tensile elasticity and a high specific frequency in the orientation direction of the sheet member.

A method of manufacturing each sheet member is desirably determined, provided that each sheet member can have an appropriate orientation dispersion structure. Specific examples of a method of manufacturing each sheet member are extrusion forming, expansion, and blow forming. Each sheet member may contain a filler having high orientation dispersion properties, so as to have high in-plane uniformity. In such a case, each sheet member may be an extrusion-formed article. With such a sheet member being the extrusion-formed article, the uniformity of each sheet member as a constituent material of the diaphragm 12 is increased, which may make it easy to obtain the speaker 1 having excellent quality uniformity. Moreover, these methods are suitable for mass production, and thus achieve a reduction in material unit costs. The first diaphragm 121 and the second diaphragm 122 are preferably manufactured by vacuum forming or pressure forming. Vacuum forming and the pressure forming can greatly reduce mold costs compared with, for example, injection molding, and thus achieve a reduction in manufacturing costs.

As illustrated in FIGS. 2A and 2B, the orientation direction D1 of the sheet member constituting the first diaphragm 121 of the speaker 1 intersects the orientation direction D2 of the sheet member of the second diaphragm 122. The intersection of the orientation direction D1 of the first diaphragm 121 and the orientation direction D2 of the second diaphragm 122 can reduce variations in the mechanical characteristics of the whole diaphragm 12 in the circumferential direction with the axis thereof (the line in the X1-X2 direction) as the center, even in a case where the mechanical characteristics of each sheet member having the orientation dispersion structure differs between the orientation direction and the direction orthogonal to the orientation direction. As a result, a reduction in a vibration loss at a high frequency and an increase in the resonant frequency of the diaphragm are achieved when the speaker 1 is driven to generate a sound pressure, which can improve the high-range acoustic characteristics of the speaker 1.

As illustrated in FIGS. 2A and 2B, in some forms of the speaker 1, the orientation direction D1 of the first diaphragm 121 and the orientation direction D2 of the second diaphragm 122 are orthogonal to each other. Specifically, the orientation direction D1 of the first diaphragm 121 is in the Y1-Y2 direction, and the orientation direction D2 of the second diaphragm 122 is in the Z1-Z2 direction. Aligning the orientation direction D2 of the second diaphragm 122, as described above, with the direction orthogonal to the orientation direction D1, in which a difference in the mechanical strength of the first diaphragm 121 with respect to that in the orientation direction D1 is the largest, can reduce variations in the mechanical characteristics of the whole diaphragm 12 in the circumferential direction with the axis thereof (the line in the X1-X2 direction) as the center. As a result, the acoustic characteristics of the speaker 1, in particular, the high-range acoustic characteristics can be improved.

Figure 3A:
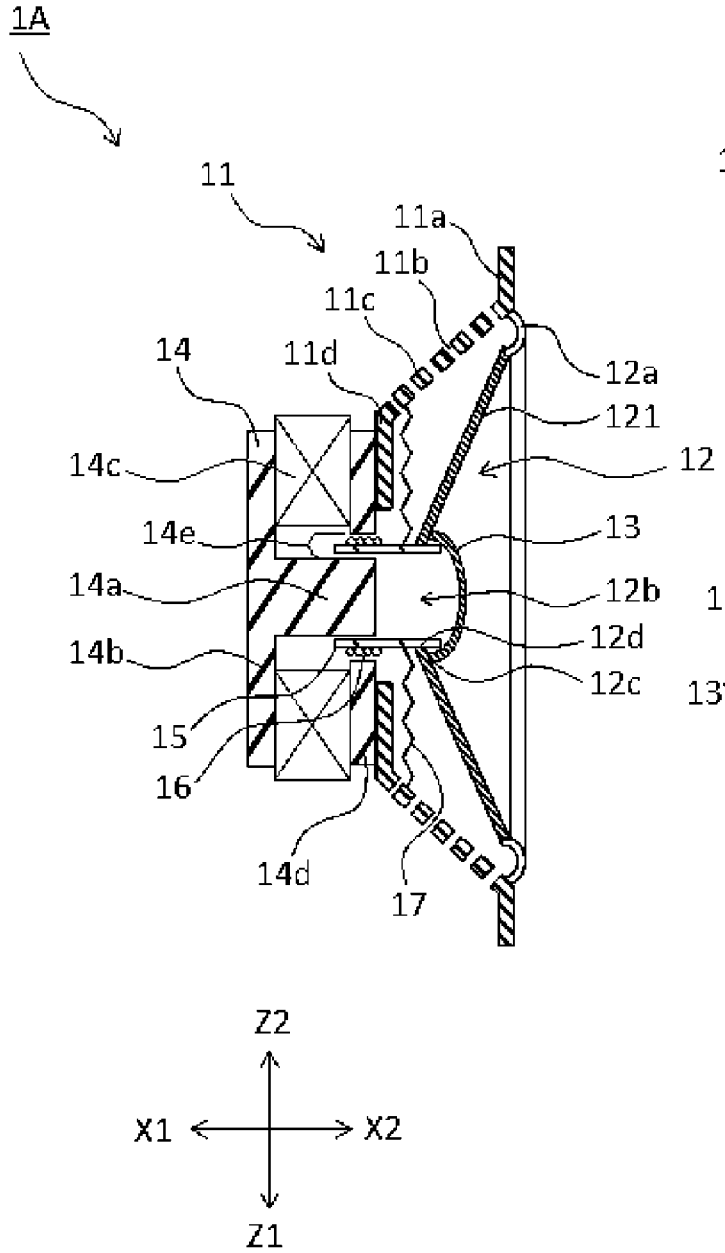
FIG. 3A is a conceptual sectional view illustrating one form of a structure of a speaker according to a modification of the first embodiment of the present disclosure.
Figure 3B:
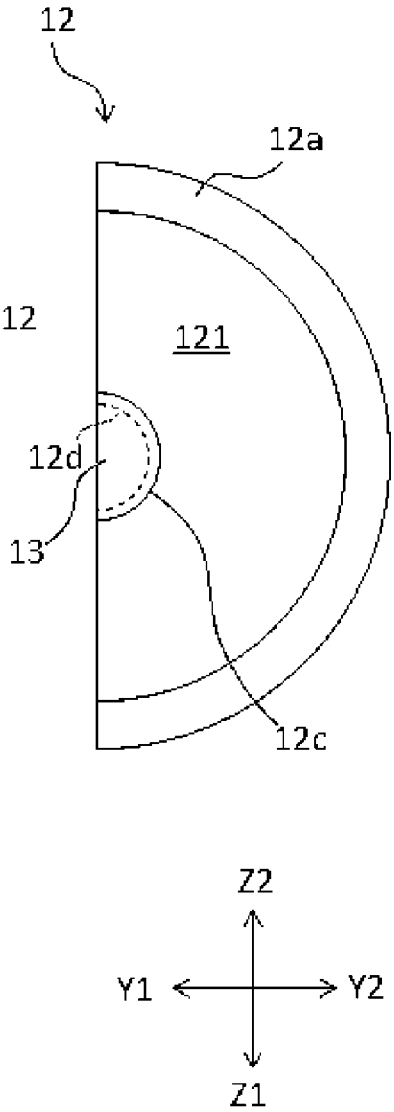
FIG. 3B is a partial plan view in the X1-X2 direction, illustrating a structure of a diaphragm included in the speaker.

FIG. 3A is a conceptual sectional view illustrating a structure of a speaker according to a modification of the first embodiment of the present invention, and FIG. 3B is a partial plan view in the X1-X2 direction illustrating a structure of a diaphragm included in the speaker. As illustrated in FIGS. 3A and 3B, a speaker 1A in the modification and the speaker 1 have the same basic structure but differ from each other in that the second diaphragm in the modification forms a dust cap 13.

The dust cap 13 is a member that is relatively small so as to cover only the bobbin 15 connected to the inner circumferential surface of the diaphragm opening 12*b* of the first diaphragm 121. Thus, an area of an outer shape (circular shape) of the dust cap 13 viewed in the axial direction (X1-X2 direction) is small compared with an area of the outer shape (circular shape) of the first diaphragm 121 viewed in the axial direction (X1-X2 direction); an area ratio between the areas is, for example, approximately 20% or less.

Although the dust cap 13 is small, as described above, variations in the mechanical characteristics of the whole diaphragm 12 in the circumferential direction with the axis thereof (the line in the X1-X2 direction) as the center can be reduced due to the orientation direction of the sheet member constituting the dust cap 13 and the orientation direction of the sheet member constituting the first diaphragm 121, which are different from each other or preferably orthogonal to each other. As a result, the acoustic characteristics of the speaker 1, in particular, the high-range acoustic characteristics can be improved.

A structure such as that illustrated in FIGS. 3A and 3B, in which a dust cap is disposed at a center portion of a cone-shaped diaphragm, is one of the most common structures in a speaker. In such a structure, when a diaphragm that includes a sheet member having the orientation dispersion structure is used, the acoustic characteristics of the speaker can be improved by employing a dust cap that includes a sheet member having the orientation dispersion structure, without additionally disposing a diaphragm that includes a sheet member having the orientation dispersion structure, that is, it is possible to improve the acoustic characteristics of the speaker through a mere design change in materials without increasing the number of components.

Figure 4:
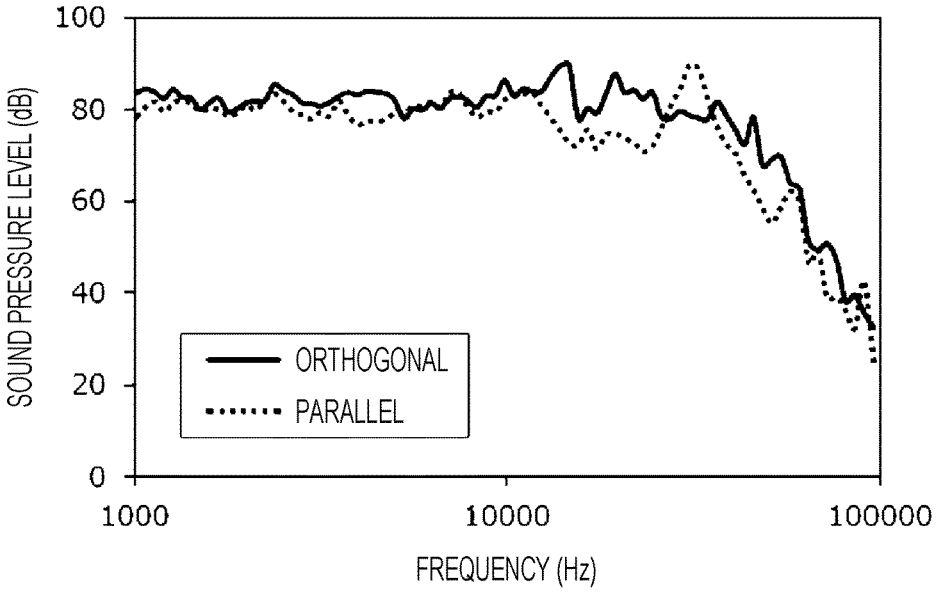
FIG. 4 is a graph showing frequency characteristics of a speaker having a structure of the speaker according to one form of the modification of the first embodiment of the present disclosure and in which a ratio of an axial-direction projected area of a member corresponding to a second diaphragm relative to an axial-direction projected area of a first diaphragm is 16%.

FIG. 4 is a graph showing, in a comparative manner, frequency characteristics (the solid line in FIG. 4) in a case where the orientation direction of the sheet member constituting the dust cap 13 and the orientation direction of the sheet member constituting the first diaphragm 121 are orthogonal to each other, and frequency characteristics (the dotted line in FIG. 4) in a case where these orientation directions are parallel to each other, in a speaker having the structure of the speaker 1A of the modification and in which the above-described area ratio (the ratio of the area of the outer shape (circular shape) of the dust cap 13, which corresponds to the second diaphragm, viewed in the axial direction (X1-X2 direction) relative to the area of the outer shape (circular shape) of the first diaphragm 121 viewed in the axial direction (X1-X2 direction)) is 17%.

FIG. 4 shows that the sound pressure level is flat until reaching 30 kHz in the frequency characteristic in the case of the orthogonal orientation directions, indicated by the solid line, and that, in contrast, in the frequency characteristic in the case of the parallel orientation directions, indicated by the dotted line, the sound pressure level decreases in the range higher than 10 kHz and, moreover, a resonance peak appears around 30 k Hz. Accordingly, even when the area ratio of the outer shape (circular shape) viewed in the axial direction (X1-X2 direction) is approximately 17%, the acoustic characteristics of the speaker 1, in particular, the high-range acoustic characteristics can be improved by disposing the member oriented in the direction orthogonal to the orientation direction of the sheet member constituting the first diaphragm 121.

Figure 5A:
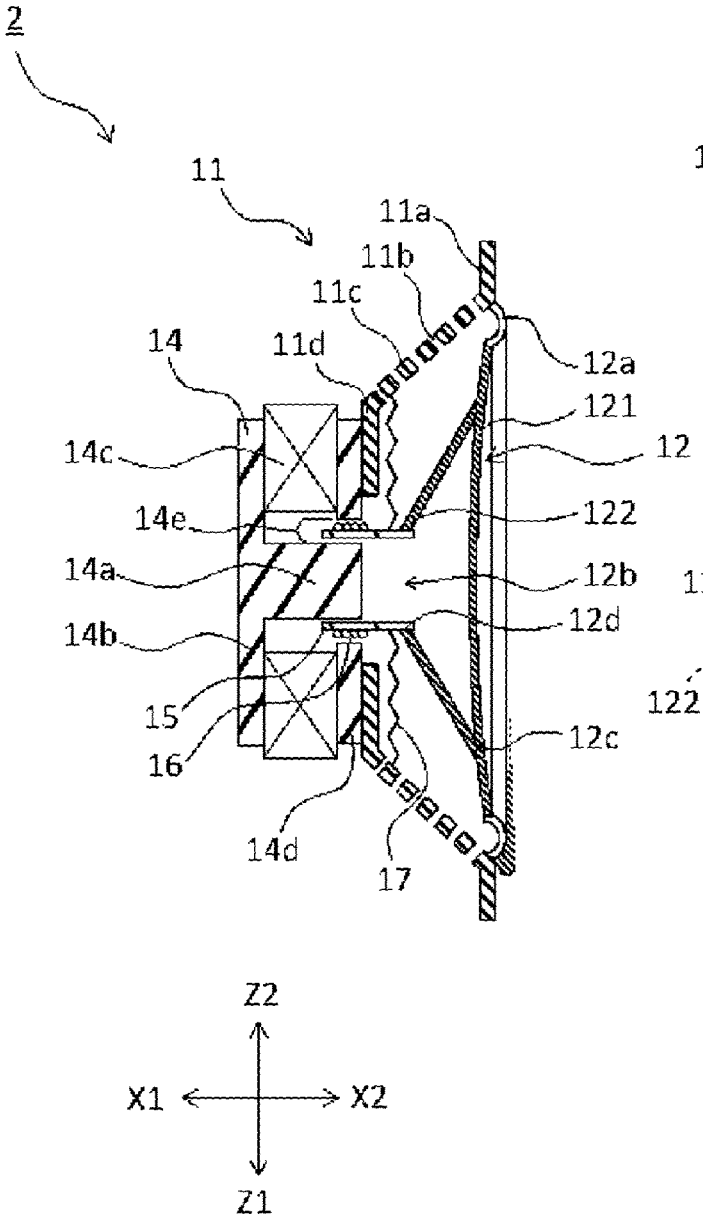
FIG. 5A is a conceptual sectional view illustrating one form of a structure of a speaker according to a second embodiment of the present disclosure.
Figure 5B:
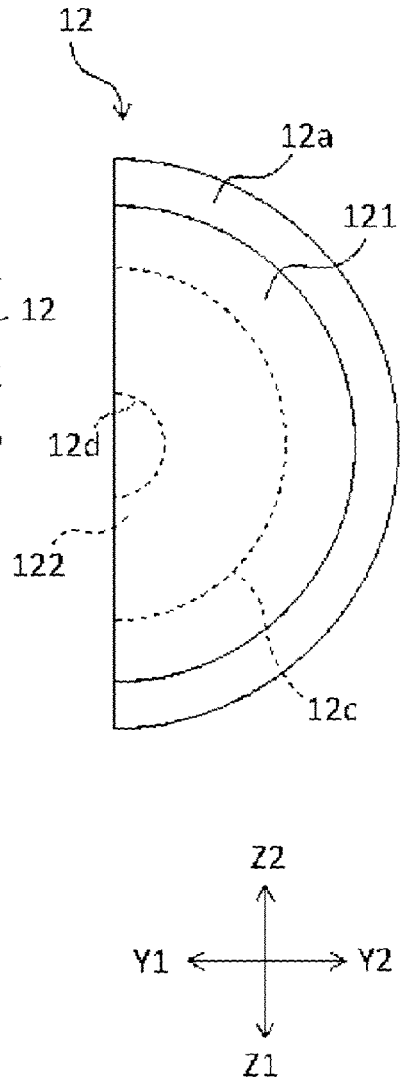
FIG. 5B is a partial plan view in the X1-X2 direction, illustrating one form of a structure of a diaphragm included in the speaker.

FIG. 5A is a conceptual sectional view illustrating one form of a structure of a speaker according to a second embodiment of the present disclosure, and FIG. 5B is a partial plan view in the X1-X2 direction illustrating a structure of a diaphragm included in the speaker. As illustrated in FIGS. 5A and 5B, a speaker 2 according to a form of the second embodiment and the speaker 1 according to a form of the first embodiment have the same basic structure and differ from each other in the shapes of the first diaphragm 121 and the second diaphragm 122 constituting the diaphragm 12.

Specifically, in the second embodiment, the first diaphragm 121 has a substantially hollow hemispherical-cap shape open to the X2 side in the X1-X2 direction and includes the flexible edge member 12*a* to thereby be attached to the annular open portion 11*a*. The second diaphragm 122 has a truncated cone shape and a circular outer shape when viewed in the axial direction (X1-X2 direction). The outer shape of the second diaphragm 122 is included in the outer shape (circular shape) of the first diaphragm 121 viewed in the axial direction (X1-X2 direction). The outer circumferential edge of the second diaphragm 122 is joined to the first diaphragm 121 to form the joined portion 12*c*. The connection portion 12*d* is disposed at a center portion of the second diaphragm 122. The bobbin 15, which is a part of the driving unit, is connected to the connection portion 12*d*.

In each of the speaker 1 and the speaker 2, the first diaphragm 121 and the second diaphragm 122 are adjacent to each other in the axial direction (X1-X2 direction) and joined together. In the speaker 1, the first diaphragm 121 and the second diaphragm 122, which are joined together, are positioned on the X1 side in the X1-X2 direction and on the X2 side in the X1-X2 direction, respectively. In the speaker 2, the first diaphragm 121 and the second diaphragm 122, which are joined together, are positioned on the X2 side in the X1-X2 direction and on the X1 side in the X1-X2 direction, respectively.

The diaphragm 12 having such a shape seems to be a flat member, not a cone-shaped member as in the case of the speaker 1, when the speaker 2 is viewed from the X2 side in the X1-X2 direction. Thus, the appearance of the speaker 2 differs from the appearance of the speaker 1. However, the speaker 2, in which the orientation direction of the sheet member of the first diaphragm 121 and the orientation direction of the sheet member of the second diaphragm 122 intersect each other similarly to in the speaker 1, is excellent in acoustic characteristics, in particular, high-range acoustic characteristics.

Figure 6A:
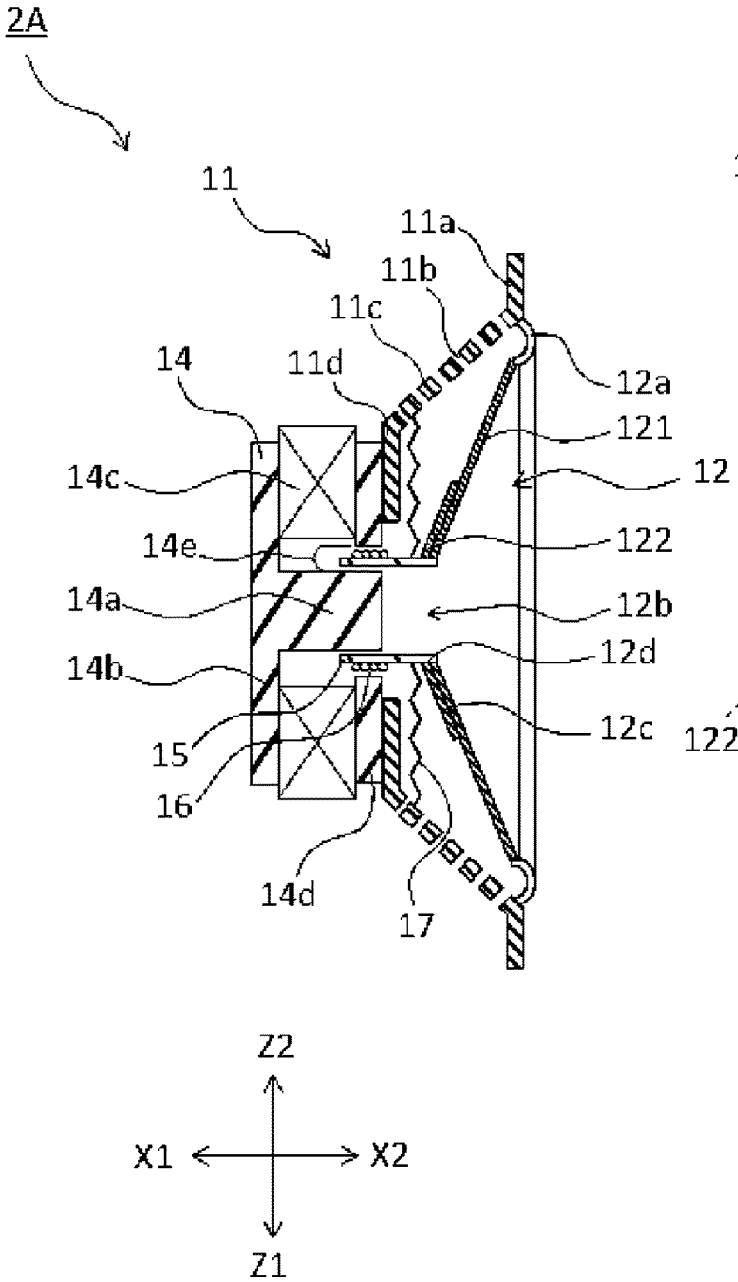
FIG. 6A is a conceptual sectional view illustrating one form of a structure of a speaker according to a modification of the second embodiment of the present disclosure.
Figure 6B:
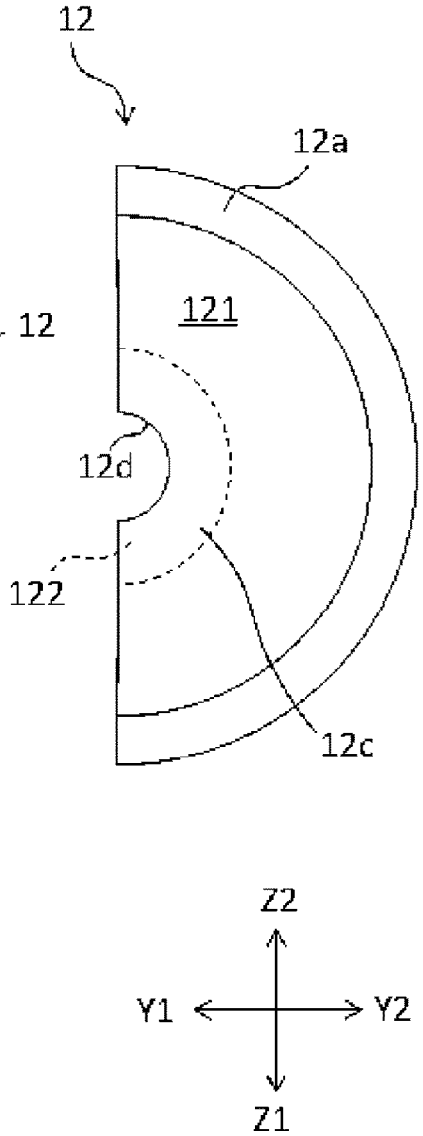
FIG. 6B is a partial plan view in the X1-X2 direction, illustrating a structure of a diaphragm included in the speaker.

FIG. 6A is a conceptual sectional view illustrating one form of a structure of a speaker according to a modification of the second embodiment of the present disclosure, and FIG. 6B is a partial plan view in the X1-X2 direction illustrating one form of a structure of a diaphragm included in the speaker. As illustrated in FIGS. 6A and 6B, a speaker 2A according to the modification and the speaker 2 according to the second embodiment may have the same basic structure and differ from each other in the shapes of the first diaphragm 121 and the second diaphragm 122 constituting the diaphragm 12.

The first diaphragm 121 of the speaker 2 has a substantially hollow hemispherical-cap shape and has a portion facing the bobbin 15 in the axial direction (X1-X2 direction). In contrast, the first diaphragm 121 of the speaker 2A has a substantially truncated cone shape. The inner circumferential surface of the diaphragm opening 12*b* positioned at a top portion of the truncated cone shape also forms the connection portion 12*d* and is connected to the bobbin 15. The second diaphragm 122 of the speaker 2A has the substantially truncated cone shape, similarly to the second diaphragm 122 of the speaker 1A, and has a surface, including the outer circumferential edge thereof, on the X2 side in the X1-X2 direction. The surface and an inner circumference-side surface of the first diaphragm 121 on the X1 side in the X1-X2 direction are joined together to form the joined portion 12*c*. Having such a structure, the overall appearance of the diaphragm 12 is cone-shaped when viewed from the X2 side in the X1-X2 direction. The first diaphragm 121 of the speaker 2A may not be connected to the bobbin 15, and the outer circumferential edge of the second diaphragm 122 and an inner circumferential edge of the first diaphragm 121 may be joined. However, the strength of the whole diaphragm 12 of the speaker 2A is expected to be higher in the structure illustrated in FIGS. 6A and 6B than in the structure described above.

The embodiments and the application examples thereof have been described above; however, the present disclosure is not limited thereto. For example, a speaker realized through appropriate addition, omission, and design change of components by a person skilled in the art with respect to the aforementioned embodiments or application examples thereof and a speaker realized through an appropriate combination of the features in the embodiments are included in the scope of the present invention, provided that such speakers realize the concept of the present invention.

For example, in each of the abovementioned speakers 1, 1A, 2, and 2A, the first diaphragm 121 and the second diaphragm 122, which are both formed of the sheet member having the orientation dispersion structure that includes the shape-anisotropic filler dispersed in the resin with the long axis thereof oriented in the predetermined direction, may be a laminated body of such a sheet member and, for example, an exterior film. Even in such a case, employing a thin exterior film can suppress the occurrence of unfavorable circumstances such that the weight of the diaphragm 12 is excessively increased due to the exterior film and causes degradation in the acoustic characteristics, in particular, a decrease in the high-range sound pressure.

The diaphragm 12 may be formed of three or more of members. For example, the diaphragm 12 of the speaker 2A illustrated in FIG. 6A may further include a member that functions as a dust cap, and the member may be formed of a sheet member having the orientation dispersion structure, similarly to other members constituting the diaphragm 12. In this case, the orientation direction of the sheet member constituting the member may be different from all of the orientation directions of the sheet members constituting the other members included in the diaphragm 12, or may be different from at least one thereof and the same as the other orientation directions.

In each of the aforementioned speakers 1, 1A, 2, and 2A, an outer shape of each of the first diaphragm 121 and the second diaphragm 122 is circular when viewed in the axial direction (X1-X2 direction); however, each outer shape is not limited to being circular. For example, each outer shape may be rectangular or oval. When the outer shape viewed in the axial direction (X1-X2 direction) has anisotropy, there is a case where variations in the mechanical characteristics of the whole diaphragm 12 in the circumferential direction with the axis thereof (line in the X1-X2 direction) as the center can be reduced by setting the orientation direction of each sheet member as appropriate in accordance with the anisotropy.

It is therefore intended that the foregoing detailed description be regarded as illustrative rather than limiting, and that it be understood that it is the following claims, including all equivalents, that are intended to define the spirit and scope of this disclosure.

What is claimed is:

1. An acoustic apparatus comprising:

a frame having an annular open portion that opens in an axial direction;

a diaphragm supported by being attached to the annular open portion via a flexible edge member so as to be capable of vibrating in the axial direction; and a driving unit that is connected, at a connection portion positioned at a center portion of the diaphragm, to the diaphragm and is configured to apply a driving force in the axial direction to the diaphragm, wherein the diaphragm includes a first diaphragm and a second diaphragm that has an outer diameter that is smaller, when viewed in the axial direction, than an outer diameter of the first diaphragm, wherein the first diaphragm and the second diaphragm are adjacent to each other in the axial direction and joined together, wherein each of the first diaphragm and the second diaphragm includes a sheet member having an orientation dispersion structure that includes a shape-anisotropic filler dispersed in a resin with a long axis of the shape-anisotropic filler oriented in a predetermined direction, and wherein an orientation direction of the sheet member of the first diaphragm intersects an orientation direction of the sheet member of the second diaphragm.

2. The acoustic apparatus according to claim 1, wherein the first diaphragm includes the flexible edge member to thereby be attached to the annular open portion and includes the connection portion at a center portion of the first diaphragm, wherein the second diaphragm viewed in the axial direction has an outer shape that is included in an outer shape of the first diaphragm viewed in the axial direction, and wherein the second diaphragm has an outer circumferential edge that is joined to a portion of the first diaphragm, the portion being positioned closer than the connection portion of the first diaphragm to an outer circumference side.

3. The acoustic apparatus according to claim 2, wherein the driving unit includes a magnetic circuit having a magnetic gap, a cylindrical bobbin inserted into the magnetic gap, and a voice coil wound around the bobbin, and wherein the second diaphragm forms a dust cap that covers the bobbin.

4. The acoustic apparatus according to claim 1, wherein the first diaphragm includes the flexible edge member to thereby be attached to the annular open portion, wherein the second diaphragm viewed in the axial direction has an outer shape that is included in an outer shape of the first diaphragm viewed in the axial direction, and wherein the second diaphragm has an outer circumferential edge joined to the first diaphragm and includes the connection portion at a center portion of the second diaphragm.

5. The acoustic apparatus according to claim 1, wherein an intersection angle between the orientation direction of the sheet member of the first diaphragm and the orientation direction of the sheet member of the second diaphragm is 45 degrees or more.

6. The acoustic apparatus according to claim 1, wherein mechanical characteristics of each sheet member in the orientation direction differ from mechanical characteristics of each sheet member in a direction orthogonal to the orientation direction.

7. The acoustic apparatus according to claim 1, wherein each sheet member contains a thermoplastic resin as a base material, and wherein each of the first diaphragm and the second diaphragm is a vacuum-formed article or a pressure-formed article.

* * * * *